US005996598A

United States Patent [19]

Watson et al.

[11] Patent Number: 5,996,598

[45] Date of Patent: Dec. 7, 1999

[54] DRAIN VALVE FOR A WAREWASHER

[75] Inventors: Michael T. Watson, Centerville; Flavil M. Pollock, Piqua, both of Ohio

[73] Assignee: Premark FEG L.L.C., Wilmington, Del.

[21] Appl. No.: 09/148,467

[22] Filed: Sep. 4, 1998

Related U.S. Application Data

[60] Provisional application No. 60/057,612, Sep. 4, 1997.

[51] Int. Cl.[6] ..... A47L 15/42; F16K 31/124

[52] U.S. Cl. ..... 134/104.1; 134/201; 251/30.01

[58] Field of Search ..... 251/30.01; 134/104.1, 134/201

[56] References Cited

U.S. PATENT DOCUMENTS

| | | | |
|---|---|---|---|
| 3,266,513 | 8/1966 | Erickson et al. | 137/577 |
| 3,355,139 | 11/1967 | Kittredge | 251/30.01 |
| 3,789,860 | 2/1974 | Katterheinrich et al. | 134/104 |
| 4,147,558 | 4/1979 | Fraula et al. | 134/10 |
| 5,383,486 | 1/1995 | Warner et al. | 137/15 |

FOREIGN PATENT DOCUMENTS

| | | | |
|---|---|---|---|
| 1414654 | 11/1965 | France . | |
| 2199082 | 9/1973 | France . | |
| 1103273 | 2/1968 | United Kingdom | B65G 53/46 |

OTHER PUBLICATIONS

PCT/US98/18534 International Search Report.

*Primary Examiner*—Philip R. Coe
*Attorney, Agent, or Firm*—Thompson Hine & Flory LLP

[57] ABSTRACT

A drain valve for controlling the flow of water from a source of standing water to a drain, the drain valve comprising: a valve body, an inlet in said valve body connectable to said source, an outlet in said valve body connectable to a drain, a fluid passageway through said valve body running from said inlet to said outlet, a cavity in said valve body intersecting said passageway, a gate disposed in said cavity, said gate being movable between an open position wherein water can flow through said passageway to a closed position wherein the flow of water through said passageway is blocked, a water supply line for supplying water under pressure to said cavity on one side of said gate, and a water supply valve for controlling the flow of water from said supply line to said cavity, whereby when said water supply valve is open, water flows into said cavity and moves said gate from said open position to said closed position and when said water supply valve is closed, said gate returns to said open position.

9 Claims, 12 Drawing Sheets

DRAIN VALVE FOR A WAREWASHER

CROSS-REFERENCE TO RELATED APPLICATION

This application claims priority under 35 U.S.C. §119 from provisional application Ser. No. 60/057,612, filed Sept. 4, 1997, the entire disclosure of which is incorporated herein by reference. To the extent that there is any conflict in the teachings in the provisional application and this application, the teachings in this application control.

BACKGROUND OF THE INVENTION

The present invention is directed to a drain valve and, more particularly, to a drain valve for a warewasher, and more particularly, to a drain valve having a hydraulic actuated gate for controlling the flow of water from a warewasher.

BACKGROUNDS OF THE INVENTION

Commercial warewashers typically include a series of spaced stations wherein the ware is washed or rinsed with water or a water/soap mixture. The used water is collected by a receptacle tank, or sump, located at the bottom of each station. During washing or rinsing operations the water is often cycled and reused several times before it is drained. Accordingly, a valve is used to control the retention of water in, and the flow of water out of, the various receptacle tanks. One example of a drain valve for a warewasher is described in U.S. Pat. No. 5,383,486. Most valves used for this purpose may be large and bulky, of complex construction, or difficult to clean. Furthermore, they may become easily clogged by food or other debris such as toothpicks, straws, or pieces of foil. In order to prevent debris from entering into the drain, the warewasher typically includes a course screen. However, some debris can and does pass through the screen. Accordingly, there exists a need for a drain valve for use with a warewasher which can control the flow of water, is easy to clean, and avoids clogging.

SUMMARY OF THE INVENTION

The present invention is directed to a drain valve and, more particularly to a drain valve for controlling the flow of water out of a warewasher tank. The valve is of relatively simple construction, is easy to clean, and is shaped so as to avoid clogging. The valve is actuated using pressurized water, which eliminates the need for a separate mechanical activator. Additionally, the valve is configured so as to automatically drain the tank when power to the warewasher is terminated.

Thus, the invention provides a drain valve for controlling the flow of water from a receptacle containing standing water to a drain, the drain valve comprising a valve body, an inlet in said valve body connectable to said receptacle, an outlet in said valve body connectable to a drain, a fluid passageway through said valve body running from said inlet to said outlet, a cavity in said valve body intersecting said passageway, a hydraulically actuated gate disposed in said cavity, said gate being movable between an open position wherein water can flow through said passageway to a closed position wherein the flow of water through said passageway is blocked, a water supply line for supplying water under pressure to said cavity on one end of said gate, and a water supply valve for controlling the flow of water from said supply line to said cavity, whereby when said water supply valve is open, water flows into said cavity and moves said gate from said open position to said closed position and when said water supply valve is closed, said gate returns to said open position.

These and other objects and advantages of the present invention will be more fully understood and appreciated by reference to the following description, the accompanying drawings and the appended claims.

DETAILED DESCRIPTION OF THE INVENTION

A warewasher typically includes a wash chamber through which the ware is passed, a plurality of wash arms located in the chamber to deliver the water to the ware. Each wash arm includes a plurality of wash nozzles, through which the water may exit. Warewashers include one or more receptacle tanks, and the valve of the present invention may be used in conjunction with any one of the plurality of tanks. The drain valve of the present invention is useful to control the drainage of any type of warewasher such as a fresh water rinse warewasher as well as a "fill and dump" warewasher. In a typical washing operation, the sump is filled with water. The water in the sump is used and reused by pumped recirculation of the wash water for washing ware. Periodically, the water in the sump is drained.

Figure 1:
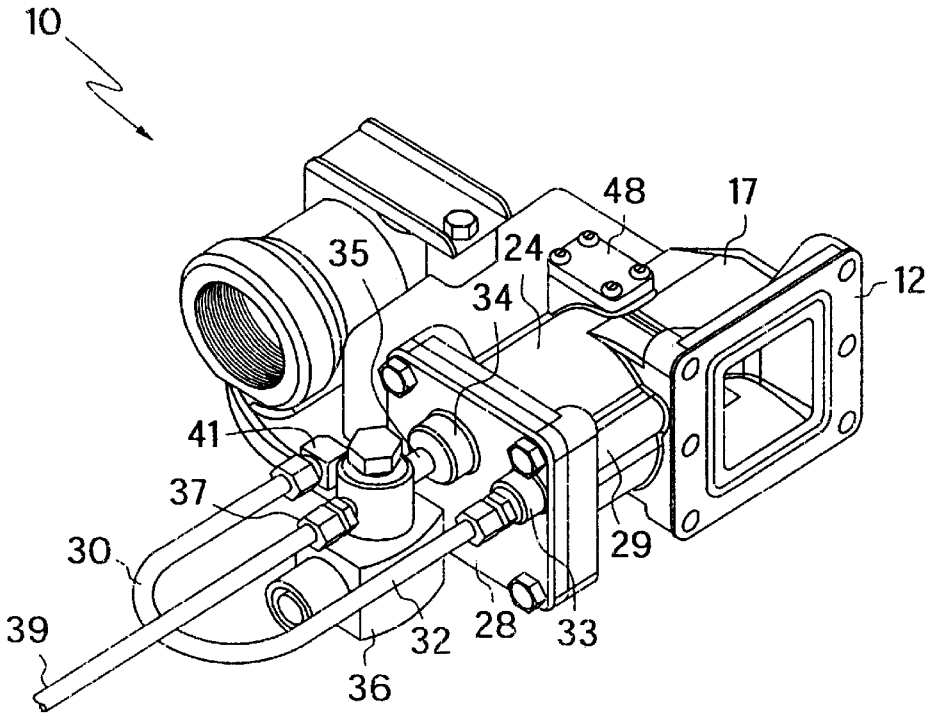
FIG. 1 is a perspective view of the valve of the present invention.
Figure 2:
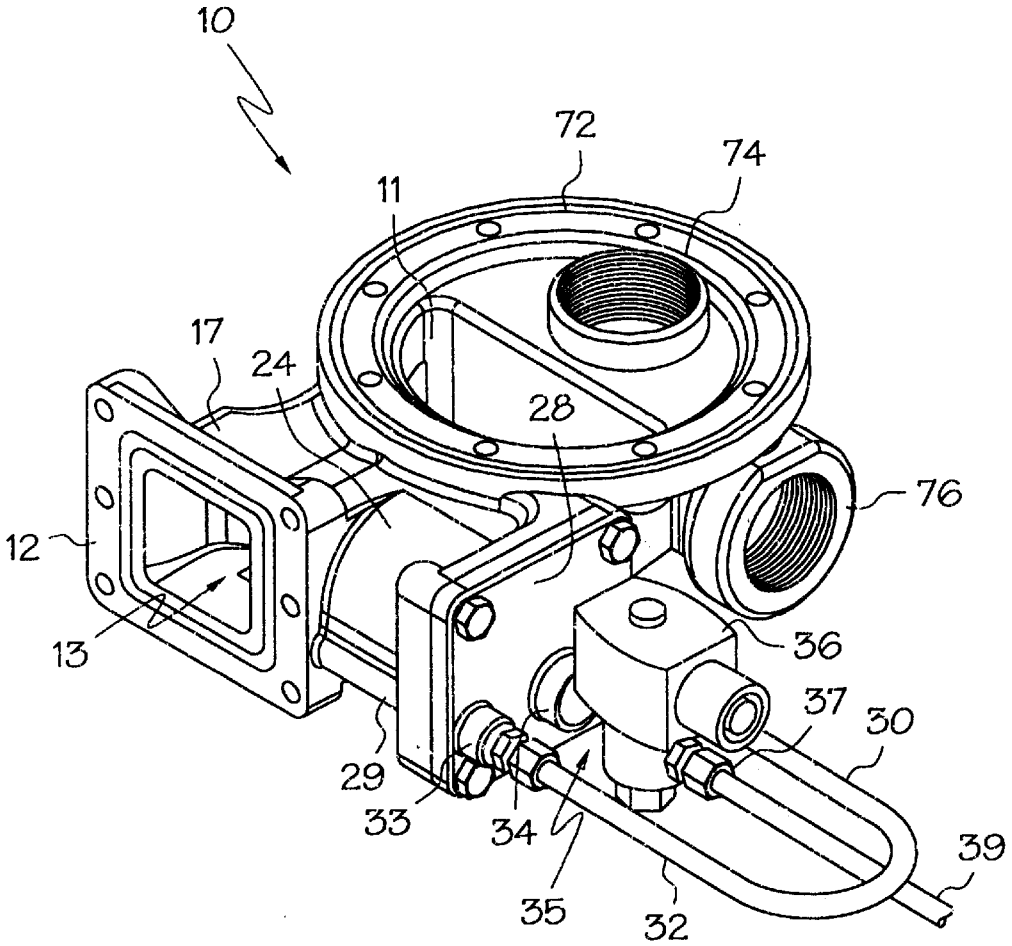
FIG. 2 is a different perspective view of the valve of FIG. 1.
Figure 3:
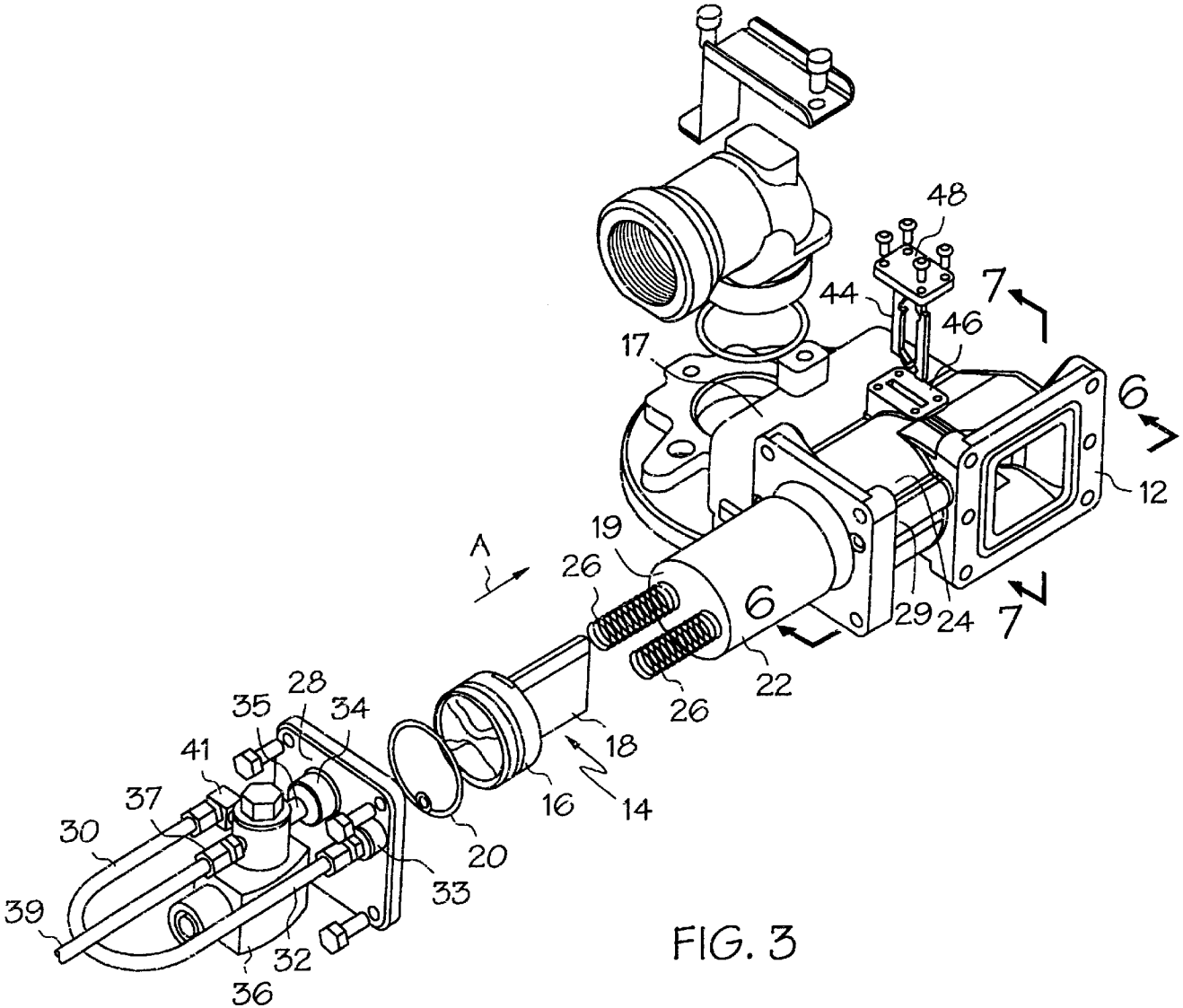
FIG. 3 is an exploded, perspective view of the valve FIG. 1.
Figure 12:
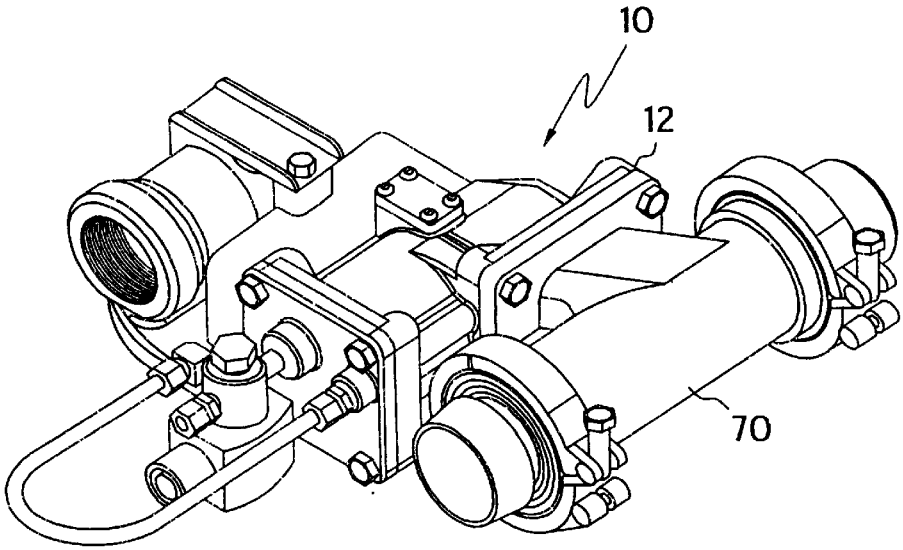
FIG. 12 illustrates the valve of the present invention assembled with a drain element.

As shown in FIGS. 1–3 the valve 10 of the present invention is used to control the flow of water out of a receptacle tank or sump (not shown) of a warewasher. The valve 10 is constructed from a valve body 17 including an outlet 12 which can be connected to a drain pipe using a T-connection 70 as shown in more detail in FIG. 12. The valve 10 is mounted to the bottom of a warewasher tank by mounting rim 72. A passageway 13 runs from the valve inlet 11 which opens within the rim 72 to the valve outlet 12 such that water flowing from the tank into the inlet 11 passes through passageway 13 and out of outlet 12. An overflow standpipe can be adjoined to the valve using threaded port 74 such that water flowing through the overflow standpipe bypasses the valve and flows directly to a drain pipe which can be joined to the threaded outlet 76. A reciprocable gate 14 (FIG. 3) is a generally piston-like element, and is movable to a closed position wherein it blocks the drain 12 to prevent water from emptying from the tank. The gate 14 is also movable to an open position whereby water is allowed to pass through the inlet 12 and exit the system.

Figure 6:
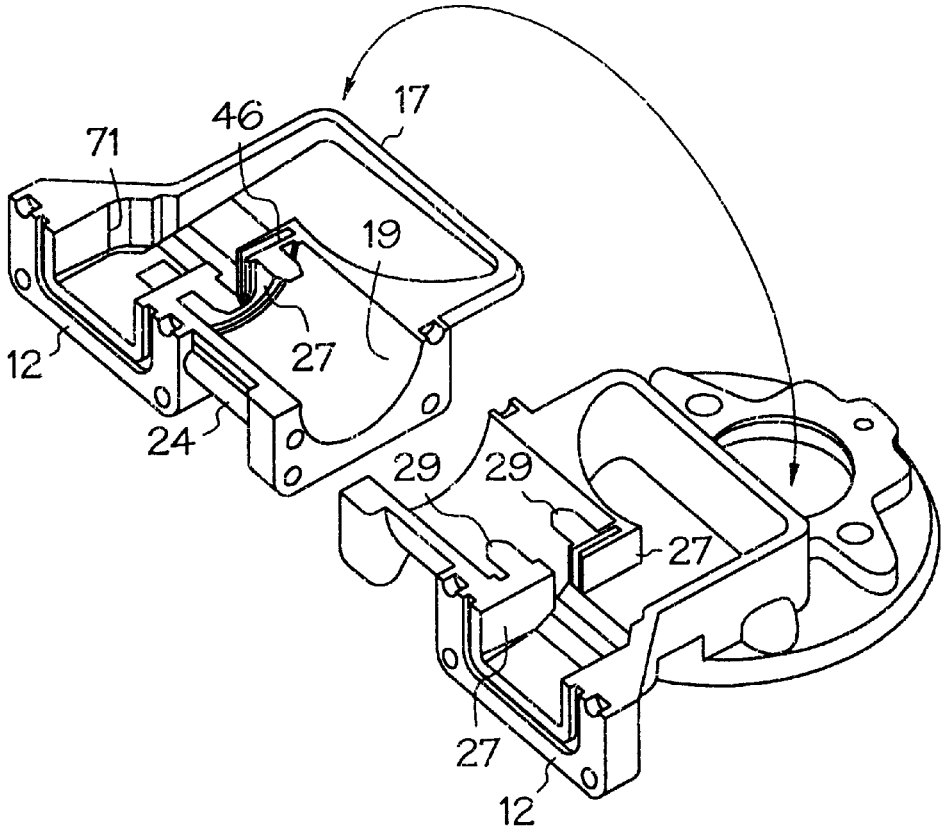
FIG. 6 is an overhead view of two halves of the valve body when it is divided along the lines 6—6 in FIG. 3.
Figure 7A:
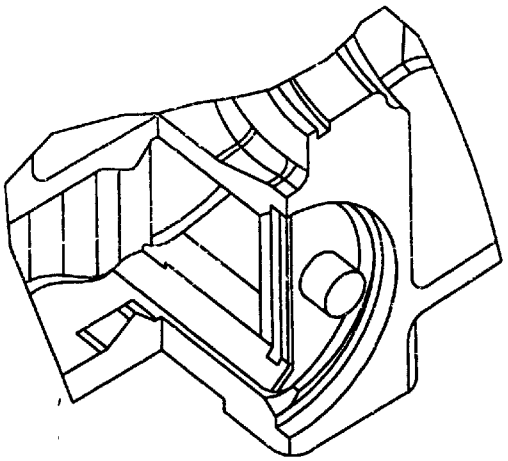
FIG. 7 is a view of two halves of the valve body when it is divided along the line 7—7 in FIG. 3.
Figure 7:
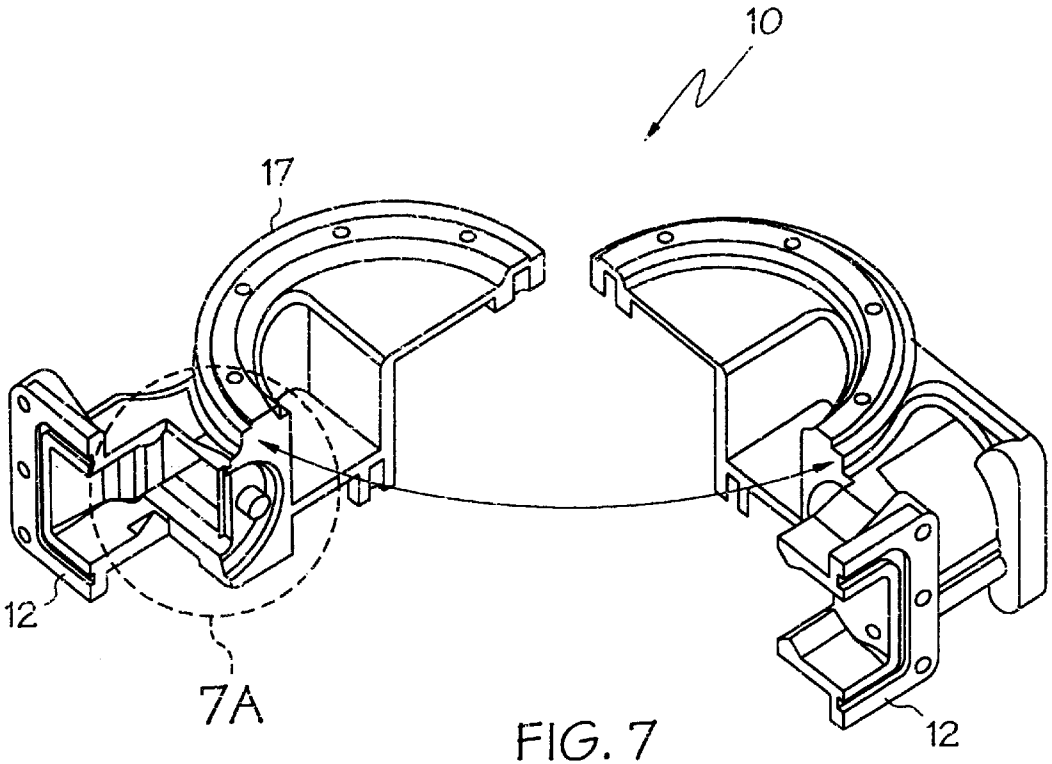

Gate 14 is constructed with a generally cylindrically actuator portion 16 and a generally rectangular portion 18. The gate 14 is slidably mounted in the sleeve 22. Sleeve 22 defines a cylindrical cavity 19 within which the gate 14 reciprocates. The sleeve 22, in turn, fits within the tubular portion 24 of the body 17. The valve body 17 includes a wall 27 (FIG. 6) separating the cavity 19 from the passageway 13, the wall 27 having a slot through which the generally rectangular portion 18 of the gate may pass. A pair of compression springs 26 (FIG. 3) is mounted between the generally cylindrically portion 16 and the wall 27. A pair of posts 29 (FIG. 6) retain the springs 26 in place. The springs 26 serve to spring bias the gate 14 in the open position. As shown in FIG. 3, the plate 28 encases the sleeve 22 and gate 14 within the housing 17. The plate 28 further retains the trigger port 34.

Figure 8:
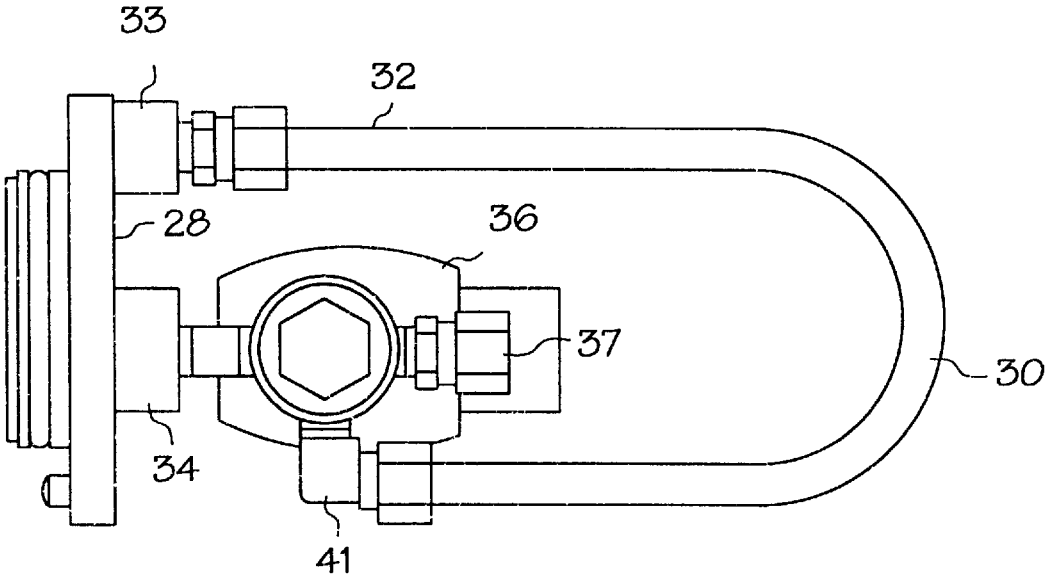
FIG. 8 is a top view of the water actuation control assembly used with the valve of the present invention.
Figure 9:
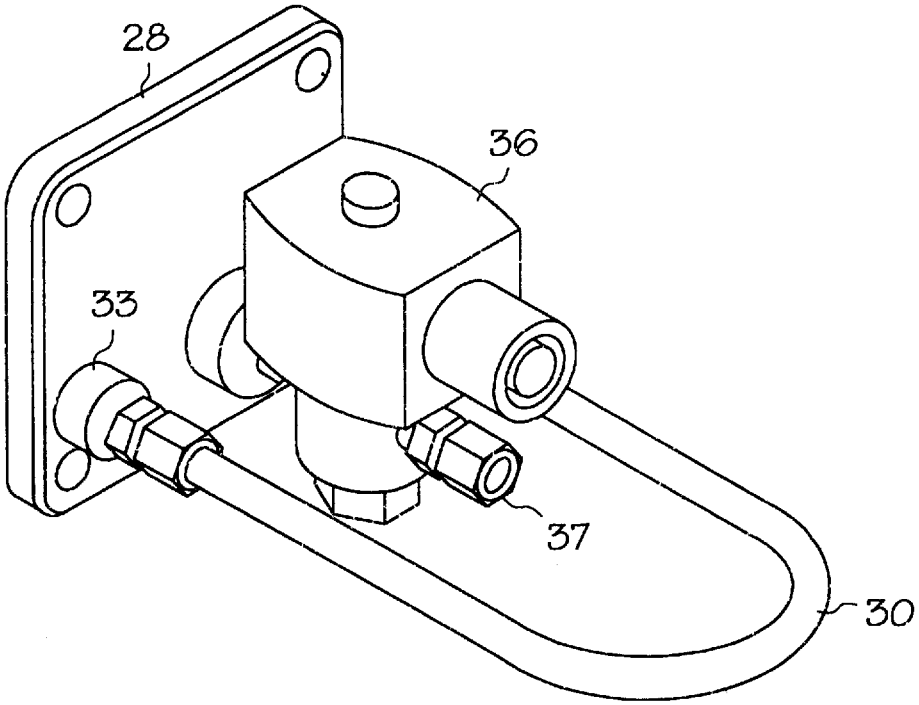
FIG. 9 is a perspective view of the water actuation control assembly of FIG. 8.
Figure 10:
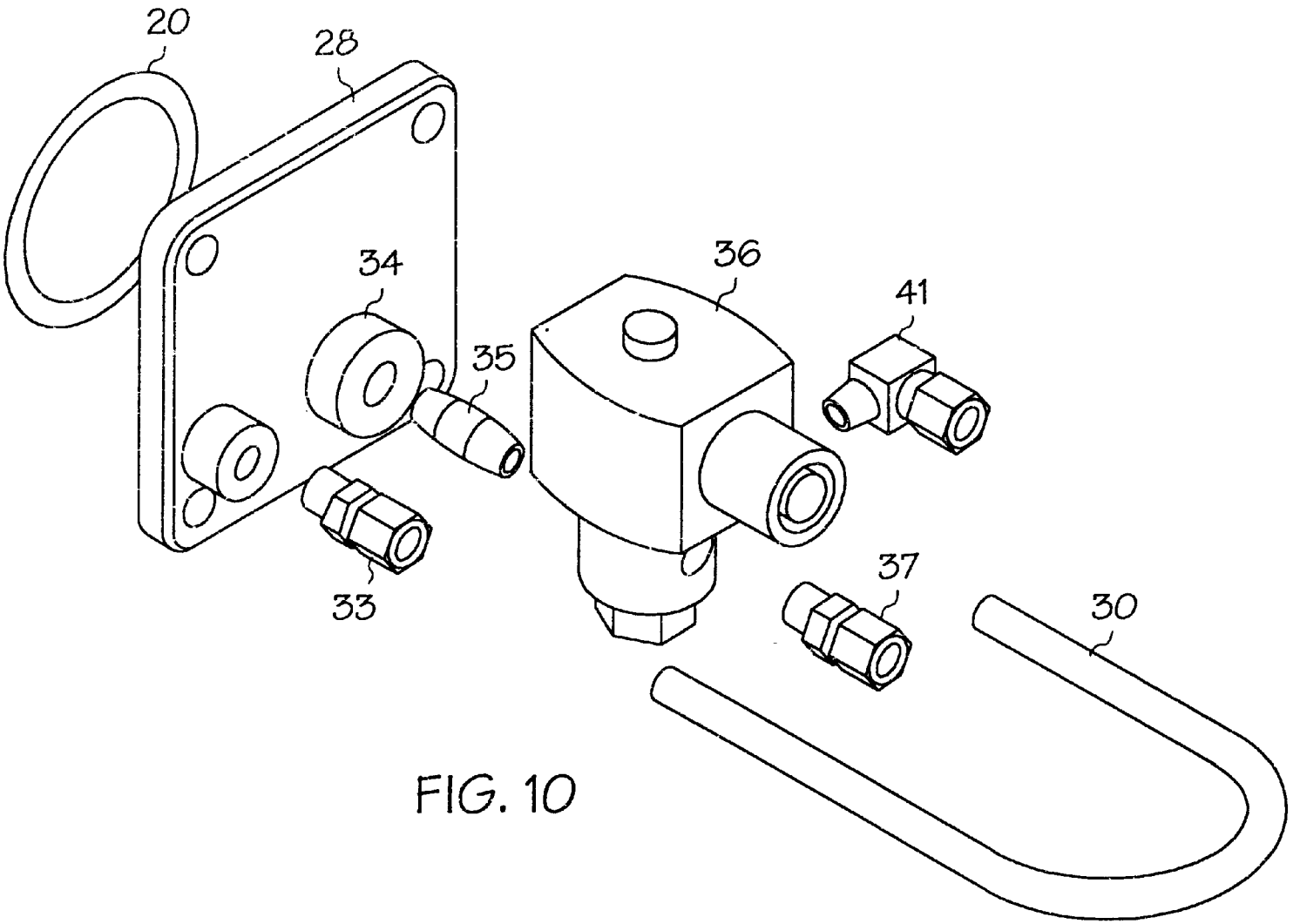
FIG. 10 is an exploded view of the water actuation control assembly.

The water actuation control assembly is shown in FIGS. 8–10. Port 34 opens on cavity 19 and is connected by a connecting pipe 35 to a three-way solenoid valve 36. The three way solenoid valve 36 receives one end of the U-shaped pipe 30 via fitting 41. Three way solenoid valve 36 receives an incoming water supply line 39 at port 37. At the exit end 32 of the U-shaped pipe 30, the pipe 30 enters the plate 28 at port 33. Port 33 interconnects the pipe 30 to the bore 29 in the side of valve 10. Bore 29, in turn, is connected to the valve outlet 12. The supply line 39 is preferably connected to the main water supply line that delivers water used to fill the warewasher machine, and thus "bleeds" water under pressure from the main supply line, as needed. While the invention is illustrated using a three-way valve, those skilled in the art will recognize that a pair of two-way valves could also be used.

Figure 4:
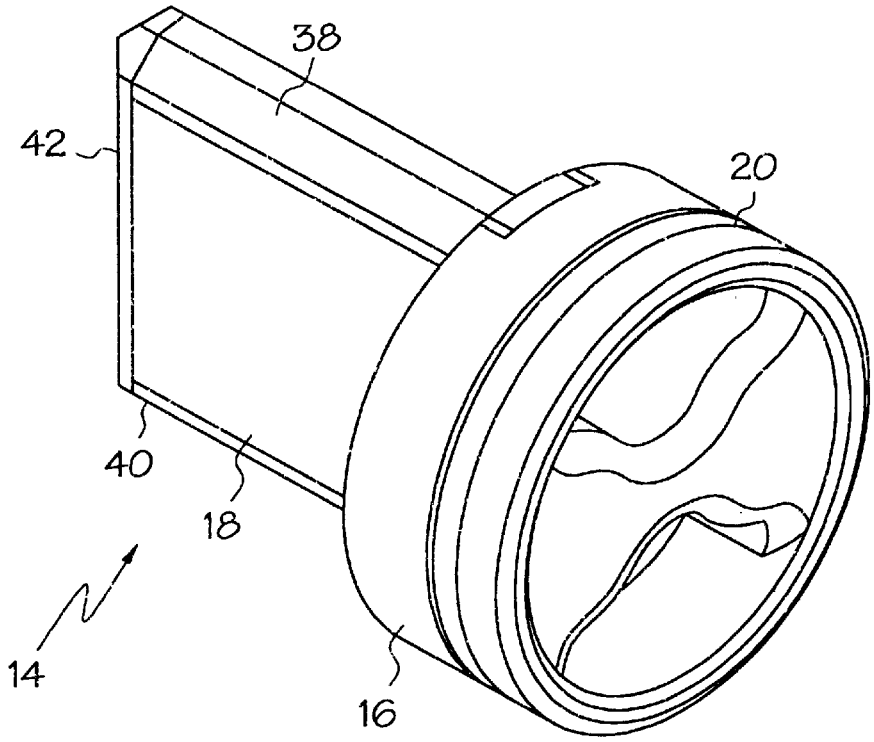
FIG. 4 is a perspective view of the gate used in the valve of the present invention.
Figure 5:
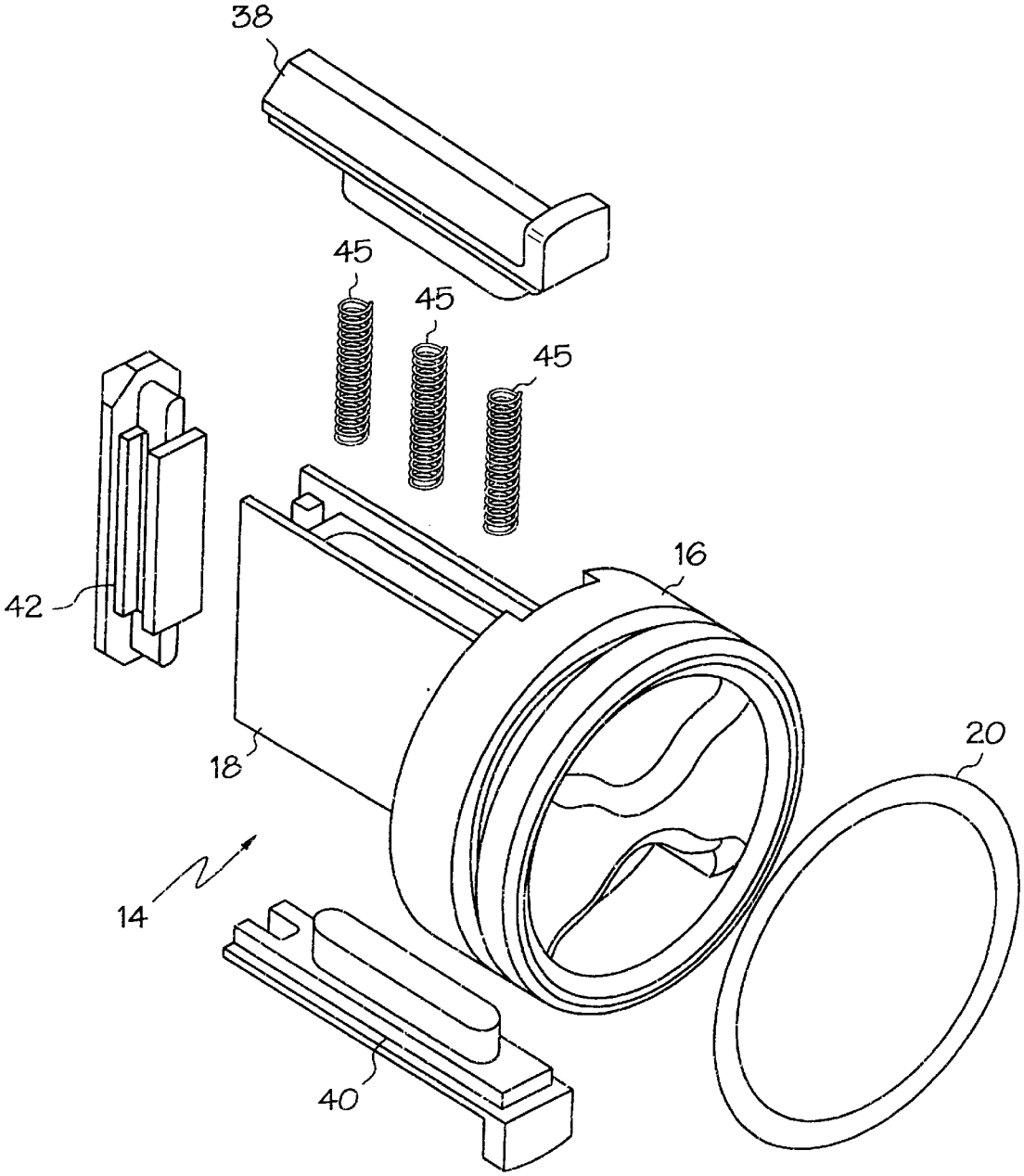
FIG. 5 is an exploded perspective view of the gate of FIG. 4.
Figure 11:
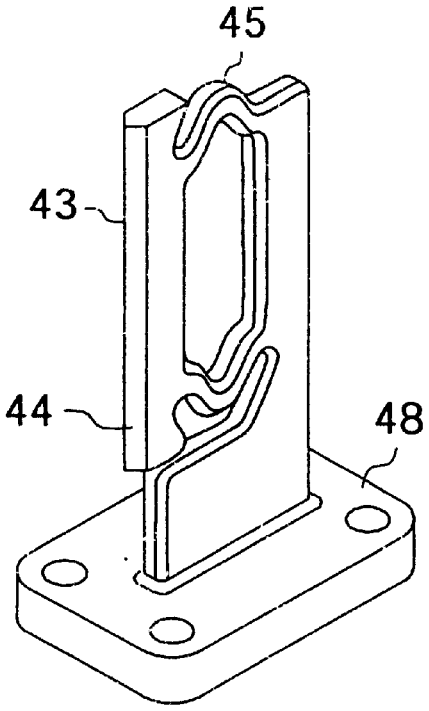
FIG. 11 illustrates a sealing gasket used in accordance with the invention.

In order to maintain a seal between the cylindrical portion 16 of the gate 14 and the sleeve 22, gasket 20 is located within an annular ring of the cylindrical portion 16. As best illustrated in FIGS. 4–5, the gate portion 18 of the gate 14 is sealed with respect to the passageway 13 by use of upper and lower seals 38, 40, and end seal 42 located at the distal end of the gate. The upper and lower seals 38, 40 are outwardly spring-biased by a set of springs 45 in order to maintain an integral seal with the walls of the valve body 17 when in the closed position. Sealing gasket 44 (FIG. 3) further helps to seal the passage 13 when the gate 14 is in the closed position. Gasket 44 is located in slot 46 adjacent to the wall 27 and the rectangular portion 18 of the gate 14. The gasket 44 is shown in more detail in FIG. 11. The gasket is formed from a material such as ultrahigh molecular weight (UHMW) polyethylene and is fabricated with a flexible bend 45 which biases the sealing edge 43 of the gasket member 44 into engagement with the surface of rectangular portion 18 of the gate 14. While gate 14 preferably is constructed as shown, it should also be evident that other constructions could be used. For example, valve body 17 could be modified to accommodate other geometries such as a completely cylindrical gate member which is hydraulically moved into a sealing position when the valve is closed.

The operation of the valve is as follows. To fill the reservoir tank the valve 10 is closed so that the entering water may be accumulated. To close the valve 10, the solenoid valve 36 is triggered to allow water from the supply line 39 to pass through the connecting pipe 35 and port 34 and enter the cavity 19. Water entering the cavity 19 imparts pressure upon the cylindrical portion 16 of the gate 14. This causes the gate 14 to advance into the tube 24 (as indicated by arrow A in FIG. 3) until the seal 42 contacts the back wall of the valve body at 71. The gate 14 is then located such that the generally rectangular portion 18 blocks access to the outlet 12, thereby inhibiting the exit water from the tank. Seals 38, 40, 42, 44, and 20 prevent leakage of water about the rectangular portion 18. The seals 38, 40 may rest in cooperating slots located in the drain 12. Continued pressure of the water from the water line 39 retains the gate in this position.

When it is desired to shift the valve to the open position to allow the water to exit the tank, the solenoid valve 36 is actuated to close line 39 and open line 30. Water is no longer supplied from the main line to the connecting pipe 35. With the hydrodynamic pressure removed from the cylindrical portion 16, the gate 14 returns to the open position under the biasing action of the springs 26. As the cylindrical portion moves to its open position, it flushes out the water contained in the cavity 19. The flushed water passes through the U-tube 30 and the bore 29, and is exhausted into the drain via outlet 12. It will also be recognized that tube 30 could be modified to drain directly into a drain pipe instead of into the valve body as illustrated herein.

The relatively simple construction of the valve of the present invention makes it easier to clean as the point of cleaning is located within several inches of the exit portion of the drain 12. If food or any other debris enters the valve 10, the operator may thereby reach into the valve body 17 to remove the obstruction. Furthermore, the solenoid valve can be configured such that when power to the valve is terminated, line 39 is closed and the valve 10 is open. Thus, whenever power is terminated such as upon shutdown, the gate is automatically biased to the open position. Thus, upon shutdown, the tanks automatically drain. This avoids water being left in the tank overnight or for an extended period of time. Furthermore, the present invention requires lower manufacturing tolerances due to the flexible seals located about the edges of the gate. This allows for less expensive manufacturing, while still retaining an effective seal.

Figure 13:
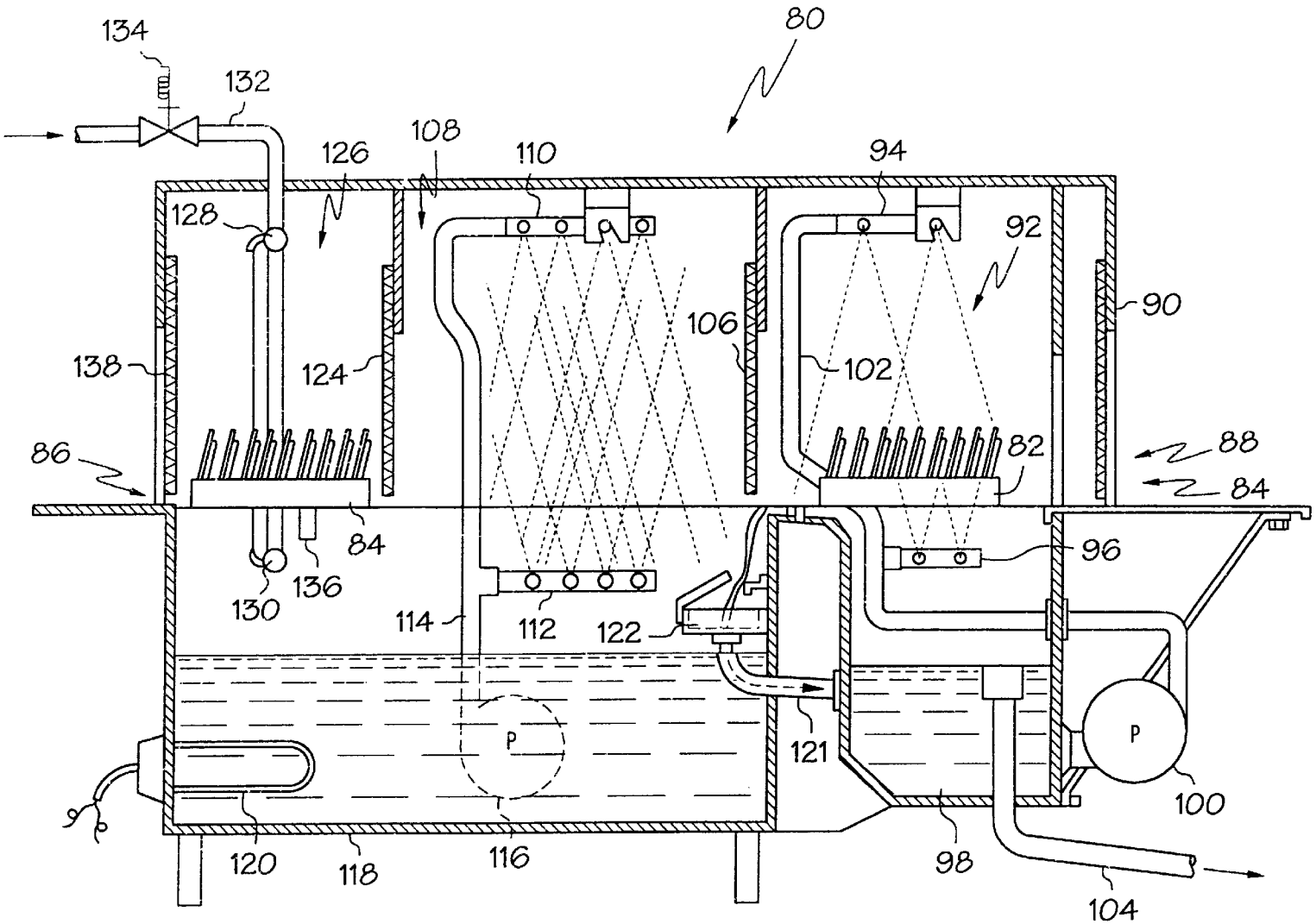
FIG. 13 illustrates one type of warewasher in conjunction with which the drain valve of the present invention can be used.

FIG. 13 illustrates a model of a conveyor-type warewasher, generally designated 80, to which the present invention is applicable. In such a warewasher, which is shown from the forward or operator side, racks of soiled ware 80, 82 are moved through tunnel-like chambers within the warewasher from an entrance end to an exit end 86, by a suitable conveyor mechanism 88. Either continuously or intermittently moving conveyor mechanisms may be used, depending upon the style, model, and size of the warewasher. The racks of soiled ware enter the warewasher through a flexible curtain 90 into a prewash chamber 92, where sprays of liquid from upper and lower pre-wash manifolds 94, 96 above and below the racks, respectively, function to flush heavier soil from the ware. The liquid for this purpose comes from a tank 98 via a pump 100 and supply conduit 102, and the level in this tank 98 is maintained by a standpipe 104 that overflows to a drain (not shown).

The racks proceed through the next curain 106 into the main wash chamber 108, where the ware is subjected to sprays of cleansing liquid from upper and lower wash manifolds 110, 112 respectively, these being supplied through supply conduit 114 by a pump 116 which draws from the main tank 118. A heater 58, such as an electrical immersion heater provided with suitable thermostatic controls (not shown), maintains the temperature of the cleansing liquid at a suitable level. Not shown, but typically included, is a device for adding a cleansing detergent to the liquid in the tank 118, along with controls for this device that maintain the concentration of detergent within desired limits. Overflow from tank 118 exits via pipe 121 into the prewash liquid tank 98. Above the overflow pipe 121 is a small catch pan 122 which may be used to direct any splash of pre-wash liquid that passes under the curtain 106 down into the overflow pipe 121 and back to tank 98. During normal operation of the warewasher 80, pumps 104, 116 are continuously driven, usually by separate motors, once the warewasher 80 is started and until the period of use of the warewasher 80 is completed.

The warewasher 80 may optionally include a power rinse chamber (not shown) that is substantially identical to main wash chamber 108. In such a case, racks of ware proceed from wash chamber 108 into the power rinse chamber, within which heated rinse water is sprayed onto the ware from upper and lower manifolds. Tank 118 is divided in such an instance into a rinse tank and a wash tank, from which the respective manifolds are separately supplied.

The racks of cleansed ware exit the main chamber 108 (or the power rinse chamber) through a curtain 124 into the final rinse chamber 126. This chamber is provided with upper and lower spray heads 128, 130 respectively, that are supplied with a flow of fresh hot water via pipe 132, under the control of a solenoid operated valve 134. A rack detector 136 is actuated when a rack of ware is positioned in the chamber 126, and through suitable electrical controls the detector causes actuation of the solenoid valve 134 to open and admit the hot rinse water to the spray heads 128, 130. The fresh water then drains from the ware into tank 118. The rinsed racks of ware then exit chamber 126 through curtain 138.

The warewasher shown in FIG. 13 further includes an access door (not shown) in the side wall of each chamber 92, 108, and 126 along the operator side of the machine. These doors enable access to each chamber interior, including the spray manifolds mounted therein, for maintenance and repair.

While the forms of apparatus herein described constitute a preferred embodiment of the invention, it is to be understood that the present invention is not limited to these precise forms and that changes may be made therein without departing from the scope of the invention.

What is claimed is:

1. A drain valve for controlling the flow of water from a receptacle of standing water to a drain, the drain valve comprising:

a valve body, an inlet in said valve body connectable to said receptacle, an outlet in said valve body connectable to a drain, a fluid passageway through said valve body running from said inlet to said outlet, a cavity in said valve body intersecting said passageway, a gate disposed in said cavity, said gate being movable between an open position wherein water can flow through said passageway to a closed position wherein the flow of water through said passageway is blocked, a water supply line for supplying water under pressure to said cavity on one end of said gate, and a water supply valve for controlling the flow of water from said supply line to said cavity, whereby when said water supply valve is open, water flows into said cavity and moves said gate from said open position to said closed position and when said water supply valve is closed, said gate returns to said open position and flushes the water from said cavity.

2. The valve of claim 1 wherein said gate is biased into said open position.

3. The valve of claim 2 wherein said valve includes a valved outlet tube which opens on said cavity at one end and opens on the valve outlet at the other end such that by opening said valved outlet tube, water can flow from said cavity on one side of said gate into said drain.

4. The valve of claim 3 wherein said cavity is lined with a cylindrical sleeve.

5. The valve of claim 4 wherein said gate includes a first seal at one end of said gate which seals said cavity such that water entering said cavity under pressure closes said valve, and said gate includes a second seal which seals said passageway such that water cannot be drained from said source.

6. The valve of claim 5 wherein said second seal includes a plurality of outwardly spring biased sealing elements.

7. The valve of claim 3 wherein said water supply valve is a three-way valve and said water supply line and said outlet tube are connected to said three-way valve such that when said three-way valve is in one position water is supplied to said cavity on one end of said gate and when said three-way valve is in a second position water flows from said cavity and to said drain.

8. The valve of claim 1 wherein said gate includes a first cylindrical portion which is in sealing engagement with said cavity and a second rectangular portion which blocks said passageway when said gate is in said closed position.

9. A warewasher comprising:

a wash chamber, a tank at the bottom of said chamber for collecting water, a drain valve for controlling the flow of water from said tank to said drain, said valve including:

a valve body, an inlet in said valve body connectable to said tank, an outlet in said valve body connectable to a drain, a fluid passageway through said valve body running from said inlet to said outlet, a cavity in said valve body intersecting said passageway, a gate disposed in said cavity, said gate being movable between an open position wherein water can flow through said passageway to a closed position wherein the flow of water through said passageway is blocked, a water supply line for supplying water under pressure to said cavity on one end of said gate, and a water supply valve for controlling the flow of water from said supply line to said cavity, whereby when said water supply valve is open, water flows into said cavity and moves said gate from said open position to said closed position and when said water supply valve is closed, said gate returns to said open position and flushes the water from said cavity.

* * * * *